United States Patent [19]

Scopetti et al.

[11] 4,195,617

[45] Apr. 1, 1980

[54] WOOD BURNING WATER-CIRCULATING STOVE

[75] Inventors: Frank A. Scopetti; Eric Vaughn, both of Ridgway; Joseph T. Manno, Kane, all of Pa.

[73] Assignee: Ridgway Steel Fabricators, Inc., Ridgway, Pa.

[21] Appl. No.: 922,587

[22] Filed: Jul. 6, 1978

[51] Int. Cl.[2] ..... F24C 13/00; F23M 7/00; F22B 31/00

[52] U.S. Cl. ..... 126/5; 122/371; 126/34; 126/53; 126/152 R; 126/193; 126/344; 126/389

[58] Field of Search ..... 126/5, 34, 53, 344, 126/365, 193, 389, 152 R, 392; 122/371

[56] References Cited

U.S. PATENT DOCUMENTS

| | | | |
|---|---|---|---|
| 408,008 | 7/1889 | Fries | 126/5 |
| 523,277 | 7/1894 | Hall | 126/5 |
| 640,924 | 1/1900 | Mander | 126/53 |
| 647,427 | 4/1900 | Sawyer | 126/5 |
| 914,085 | 3/1909 | Supper | 126/5 |
| 1,069,918 | 8/1913 | Cartwright | 126/5 |
| 1,125,183 | 1/1915 | Rymal | 126/5 |
| 1,354,055 | 9/1920 | Murphy | 126/5 |
| 1,500,843 | 7/1924 | Pettersson | 126/5 |
| 2,372,086 | 3/1945 | Kahn | 126/5 |
| 4,142,506 | 3/1979 | Morris et al. | 126/5 |

*Primary Examiner*—James O. Yeung
*Assistant Examiner*—Daniel J. O'Connor
*Attorney, Agent, or Firm*—Cushman, Darby & Cushman

[57] ABSTRACT

A wood or coal burning stove having walls defining a fire chamber with a flue disposed in one of the walls. A door provides access to the fire chamber, and a vent for controlling the combustion air is provided in the door. A manifold connected to inlet and outlet pipes passing through the walls provides for circulation of water through the fire chamber to heat the water with a fire burning in the fire chamber. Fuel supporting members extend downwardly from the manifold to support the fuel below the manifold, a number of generally U-shaped pipes with both ends of each pipe in fluid communication with the manifold providing the fuel supporting members. A baffle or like structure is provided in the manifold for preventing short-circuiting between the inlet and outlet pipes, and the manifold is supported in a generally horizontal plane. A damper is movable between a start-up position wherein gases may flow directly from the fire through the flue, to a normal position wherein gases are forced to flow both past the bottom and top of the manifold before exiting the flue.

17 Claims, 4 Drawing Figures

WOOD BURNING WATER-CIRCULATING STOVE

BACKGROUND AND SUMMARY OF THE INVENTION

Wood or coal burning stoves having water-circulating structures are known, such as shown in U.S. Pat. Nos. 914,085; 1,125,183, and 1,500,843. While such stoves are generally useful, they provide rather complicated and clumsy structures for the circulation of water, structures that are not readily accessible nor subject to high efficiency heat exchange.

According to the present invention, a water-circulating wood or coal burning stove that overcomes disadvantages inherent in the prior art is provided. The stove according to the invention is capable of a heat output of 40,000 Btu/hr into the water circulating within the stove, with 10,000 Btu/hr radiating from the stove body, provides components that are readily shippable, removable, and replaceable, provides high efficiency heat exchange, a damper system for easy start-up and to prevent back-puffing during loading and illiminates the necessity for firebricks since the water-circulating structure protects the top and side walls and high temperature asbestos board may be placed on the bottom of each unit to protect the floor.

The stove according to the present invention includes walls defining a fire chamber with a flue disposed in one of the side walls, and a door in one of the walls for providing access to the fire chamber. The means for circulating water through the first chamber comprise a manifold having an inlet pipe and an outlet pipe extending into the hollow interior thereof, the inlet and outlet pipes passing through the walls, means for preventing short-circuiting between the inlet and outlet pipes, and means for supporting the manifold in a generally horizontal plane. Fuel supporting members extend downwardly from the manifold to support the fuel below the manifold; preferably the fuel supporting means comprise a plurality of generally U-shaped pipes, both ends of each pipe being in fluid communication with the manifold, and water circulating from the inlet pipe, through the manifold, through first ends of each of the pipes, to the opposite ends of the pipes, and back through the manifold to the outlet pipe. The pipes may then be connected up to a heating system, as shown in U.S. Pat. Nos. 3,958,755 or 4,025,043, or by the references cited in the examination of those patents, or in other manners that are conventional.

The short-circuit preventing means preferably comprises a baffle dividing the manifold with the inlet pipe on one side of the baffle and the outlet pipe on the other side of the baffle, and one end of each pipe on one side of the baffle and the other end of each pipe on the opposite side of the baffle. The baffle may comprise an angle iron having one leg thereof extending vertically between the top and bottom of the manifold and the other leg flush against the top of the manifold, with a plug extending from the flush leg through the top of the manifold and welded around the periphery thereof to the manifold top.

Gas flow control means are provided associated with the manifold and positioned with respect to the flue to provide for easy start-up yet high efficiency heat exchange during operation after start-up. The gas flow control means includes a damper disposed at approximately the same horizontal level as the manifold and adjacent the wall in which the flue is disposed, and located below the flue. In one position of the damper, off gases from the fire flow past the bottom of the manifold and out the flue—for easy start-up—and in another position of the damper, off gases necessarily pass past the bottom and the top of the manifold before going out the flue, heating the top surfaces of the stove in passing between the top of the manifold and the top of the stove.

The means for supporting the manifold in a generally horizontal plane comprise releasable means for attaching the inlet and outlet pipes to one of the walls, so that upon release of such means the entire manifold with U-shaped pipes may be removed to provide a normal wood burning stove, or for cleaning or replacement of the manifold and associated pipes. A pair of ledge supports extending horizontally on the interior of the side walls of the stove also provide support for the manifold yet do not hinder removal thereof from the fire chamber.

It is the primary object of the present invention to provide an improved wood or coal burning water-circulating stove. This and other objects of the invention will become clear from an inspection of the detailed description of the invention, and from the appended claims.

DETAILED DESCRIPTION OF THE INVENTION

Figure 1:
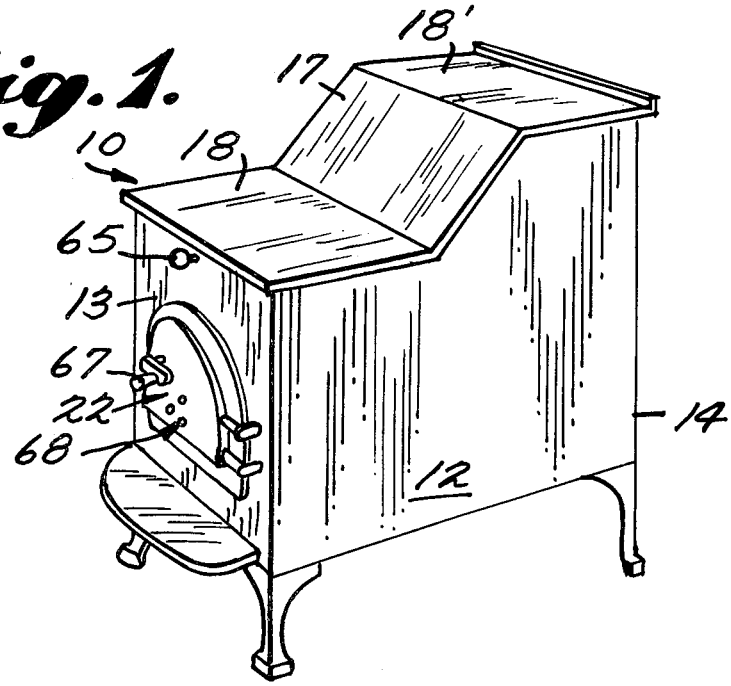
FIG. 1 is a perspective view of an exemplary stove according to the present invention.
Figure 4:
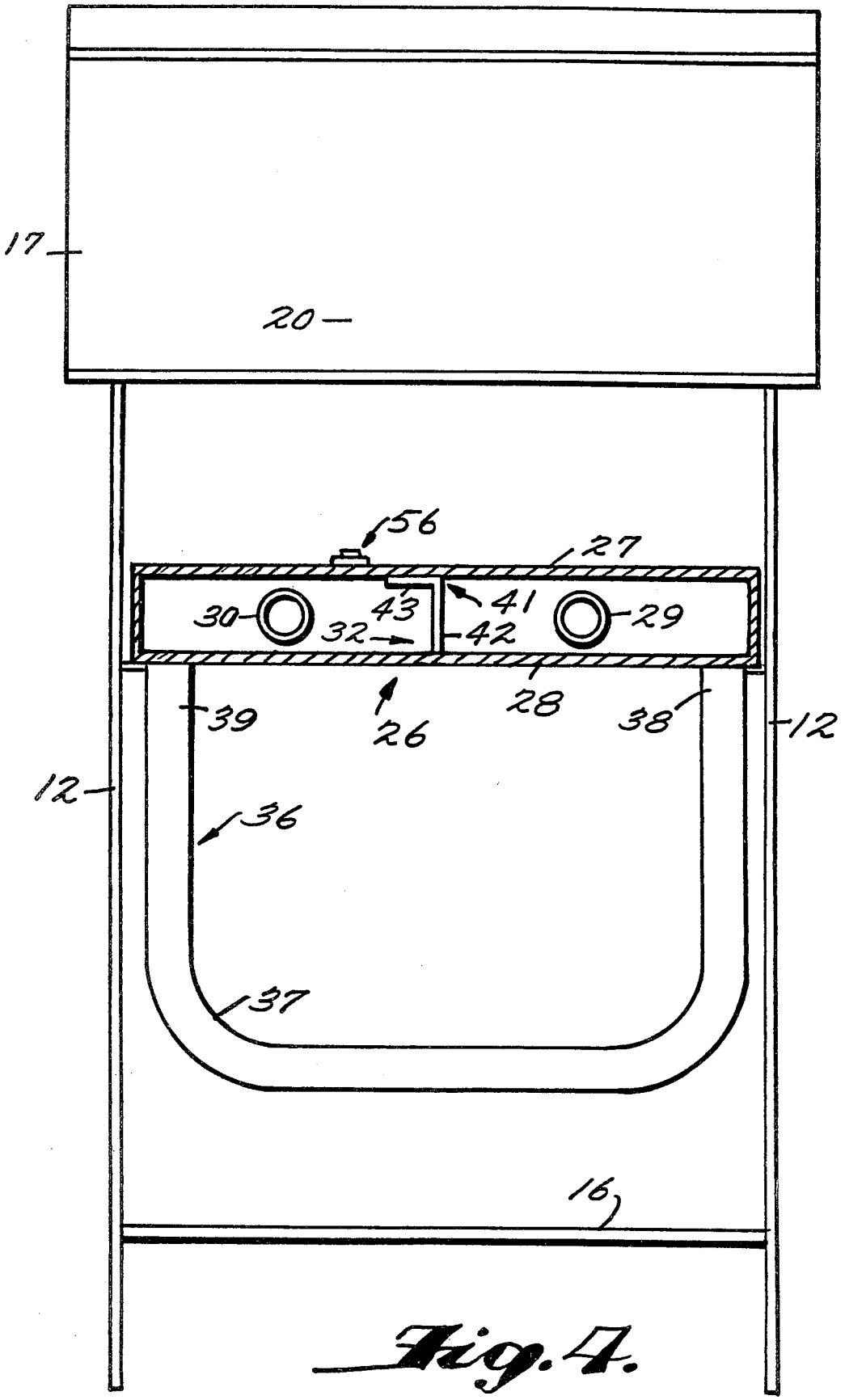
FIG. 4 is a front view of the stove with the front door removed, and showing part of the manifold in cross-section.

A wood or coal burning stove according to the present invention is shown generally at 10 in FIG. 1. This stove includes side walls 12, a back wall 14, a bottom wall 16, and a top wall 17, with cooking surfaces 18, 18' disposed at different vertical levels, the walls defining a fire chamber A (see FIG. 4). A flue 20 is disposed in one of the walls—preferably the rear wall 14, and a door 22 is provided in another of the walls—preferably the front wall 13, the door providing access to the fire chamber A. Means 24 are provided for circulating water through the fire chamber to heat the water by a fire burning in the fire chamber.

Figure 2:
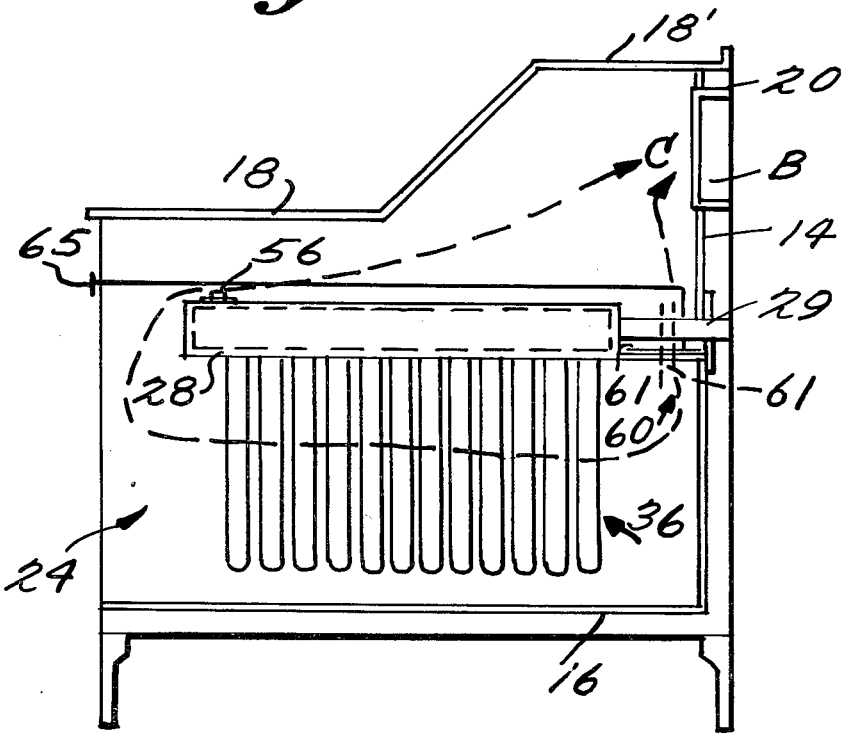
FIG. 2 is a side view with the side and front walls removed of the stove of FIG. 1.

The water-circulating means 24 includes a manifold 26 with top and bottom surfaces 27, 28, respectively thereof, and an inlet pipe 29 and an outlet pipe 30 extending into the hollow interior of the manifold 26. The pipes 29, 30 also pass through one of the walls of the stove 10, preferably the back wall 14, at a position below the flue 20. Means 32 are provided for preventing short-circulating of water between the inlet and outlet pipes 29, 30, and means 34 are provided for supporting the manifold in a generally horizontal plane (see FIGS. 2 and 4). Fuel supporting members 36 extend downwardly from the manifold to support fuel below the manifold so that a fire may burn directly below the manifold (see FIG. 4 in particular).

The fuel supporting members 36 preferably comprise a plurality of generally U-shaped pipes 37, each end 38, 39 of each pipe being in fluid communication with the manifold, and disposed on opposite sides of the manifold. When the short-circuit preventing means 32 is provided by a baffle, the pipe ends 38, 39 are disposed on opposite sides of the baffle.

The short-circuit preventing means 32 preferably comprises a baffle separating the inlet and outlet pipes 29, 30. The baffle preferably comprises an angle iron 41, having a vertical leg 42 thereof extending between the top and bottom surfaces 27, 28 of the manifold 26, and providing a supporting function within the manifold. A second leg 43 of the angle iron 41 extends flush against either the top or bottom of the manifold—preferably the top 27 as shown in the drawings. The vertical leg 42 may be skip welded to the bottom 28, while the top leg 43 is preferably attached to the top wall 27 by providing a plug 44 which extends upwardly through the top 27 of the manifold 26, passing through and opening in the top of the manifold 26, the plug 44 being welded around the periphery thereof to the top surface 27. Other conventional manners may be utilized for connecting the baffle to the manifold, however. Also, the short-circuit preventing means 32 may be provided by an inlet pipe that is very long and extends almost to the front end of the manifold, while the outlet pipe 30 is very short and extends only a small distance past the back of the manifold into the manifold hollow interior. Also, the means 32 may be provided by providing two separate sections of manifold, one connected to the inlet pipe 29 and one connected to the outlet pipe 30, or by providing orientation of the inlet and outlet pipes through different walls of the manifold, or by other means for accomplishing the desired end results.

The means 34 for supporting the manifold 26 in a generally horizontal plane includes means for releasably attaching the inlet and outlet pipes to one of the walls of the stove—preferably the back wall 14 below the flue 20. Such means may include a pair of plates 50, one mounted to the inlet pipe 29 and the other mounted to the outlet pipe 30. The plates are connected by releasable coupling means such as bolts 51 and nuts 52 to the back wall 14. The support means further include a pair of ledge supports 54 which engage the bottom wall 28 of the manifold 26 along the sides thereof, the ledges 54 supporting the manifold but not impeding movement of the manifold in a direction toward or away from the back wall 14. In this way, by merely undoing the few bolts 51 with nuts 52 connecting the plates 50 to the back wall 14, the entire manifold 26 with fuel supporting means 36 may be slid out of the front door of the stove. In this way, the stove according to the invention can be converted to a conventional radiating stove. If the heat exchanger 26 is replaced with a piece of heavy gauge steel, the stove can serve as a space heater.

The manifold 26 is also preferably provided with an air vent 56 on the outlet side thereof to allow release of air from the manifold 26 after placement of the water therein. With the manifold 26 and U-shaped pipes 37 thereof in place inside the fire chamber, the maximum outer surface temperature of the side walls 12 of the stove 10 was only about 375° F., whereas without the water-circulating tubes 37, the temperature of the side walls reached 600° F. Thus, the tubes 37 provide protection for the side walls of the stove 10, while the manifold 26 prevents overheating of the cooking surfaces 18, 18' on the top of the stove 10.

Figure 3:
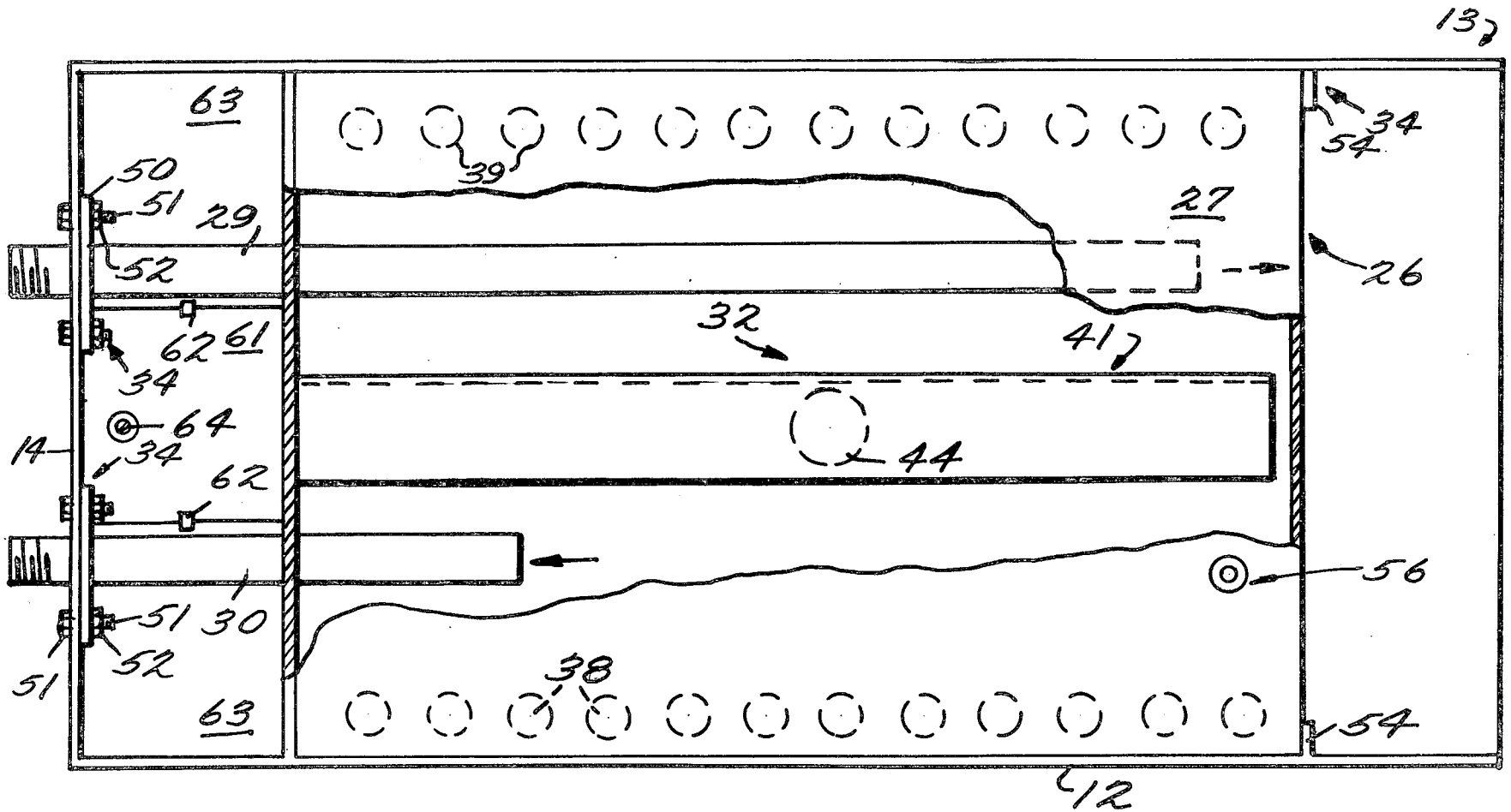
FIG. 3 is a top plan view, with portions of the top cut away, of the manifold utilized with the stove according to the invention, including the connection of the inlet and outlet pipes to the manifold and through the back wall of the stove.

In order to provide for easy start-up and to prevent back-puffing during loading of the stove, yet providing for efficient exchange of heat across the manifold, movable gas flow control means 60 (see FIGS. 2 and 3) are provided. The means 60 comprises a damper 61 that is pivotally mounted by pivots 62 at approximately the same vertical level as the manifold 26 (i.e., even with ledge supports 54), the damper sealing and opening at the back of the manifold 26 and pipes 37, the opening being sealed on the side portions thereof by plates 63. A control rod 64 is operatively connected to the damper 61 off of the line extending between the pivots 62, and the control rod has an operating portion 65 accessible at the front 13 of the stove. By operating the control rod 65, the damper 61 can be moved from the closed position shown in solid line in FIG. 2, to the open position, shown in dotted line in FIG. 2. In the closed position, which is the normal operating position of the stove, off gases from the fire burning in the chamber A pass beneath the manifold 26, and over the top surface 27 thereof and between the top surface 27 thereof and the cooking surfaces 18, 18' of the stove top 17, as shown by arrow C in FIG. 2. With the damper 61 open, which is the normal position during start-up and loading, off gases from the fire can flow directly past the damper 61 directly to the flue 20, as shown at arrow B in FIG. 2. The door 22 on the front 13 of the stove 10 provides access to the fire chamber A for loading or the like, and preferably the door 22 is pivotally mounted to the front of the stove, with the handle 67 of the door 22 spaced a good distance from the front 13 and door 22 so that it stays relatively cool and so that it can be grasped and the door opened without the operator burning his or her knuckles. Additionally, adjustable vent means 68 are provided in the front of the door for controlling the amount of combustion air that can flow into the fire chamber A. The vent may comprise a disk having three segments cut out, the three segments cooperating with corresponding segment-shaped openings formed in the front of the door 22. By rotation of the disk with respect to the door front about a pivot, the registry between the disk segments and the openings in the door front can be controlled. With the vent in the open position, a heat output in excess of 40,000 Btu/hr into the water circulating in the fire chamber can be achieved, whereas when the vent 68 is in a position where it is virtually closed, the heat output into the water will be approximately 25,000 Btu/hr.

While the invention has been described with respect to the preferred embodiment, it will be understood that many modifications are also possible within the scope of the invention. For instance, the readily releasable means for supporting the manifold in a horizontal plane may comprise the ledge supports 54 with the entire back wall 14 of the stove being detachable by bolts or the like, with a detachable connection of the pipes 29, 30 to the back wall 14. Additionally, a detachable tray may be provided at the bottom of the supports 36 above the bottom wall 16 for easy cleanout. Additionally, an "oven" could be provided directly below the top cooking surface 18', which oven would be heated by circulation of exhaust gases in pathway C, and suitable access could be provided thereto.

The invention now having been described, a typical manner of operation thereof will now be set forth. The manifold 26 is placed on the ledges 54, and the inlet and outlet pipes 29, 30 are passed through the back wall 14 below the flue 20 and connected up to a suitable heat exchanging system (such as shown in U.S. Pat. No. 3,958,755). Wood or coal or the like is then loaded on top of the pipes 37 in fire chamber A, and the control portion 65 for the damper control rod 64 is operated to pivot the damper 61 about pivot 62 to the dotted line position in FIG. 2, so that the damper is open. As the fire starts burning, off gases from the fire will pass underneath the bottom 28 of the manifold 26, in pathway B directly out the flue 20. Once start-up has been completed, the control 65 is actuated to close the damper 61 (solid line position in FIG. 2) so that the gases are forced to flow from the fire past the bottom 28 of the manifold, and between the top surface 27 thereof and the cooking surfaces 18, 18' on the top 17 of the stove 10 out pathway C through the flue 20. The adjustable vent means 68 are controlled to vary the Btu output of the stove, and the surfaces 18, 18' can be used for cooking at the same time that the water circulating through the manifold 26 and pipes 37 is being heated and transferred to a remote location. When more fuel for the fire is needed, the damper 61 is again opened, to prevent backpuffing, the door 22 is opened by grasping of the handle and pivoting it outwardly, more fuel is added on top of the pipes 37, the door is closed, and then the damper 61 is once again closed.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A wood or coal burning stove comprising walls defining a fire chamber, with a flue disposed in one of said walls, a door in one of said walls providing access to the fire chamber, and means for circulating water through the fire chamber to heat the water with a fire burning in the fire chamber, said means including a manifold having an inlet pipe and an outlet pipe extending into the hollow interior thereof and passing through said walls; means for preventing short-circuiting between said inlet and outlet pipes; means supporting said manifold in a generally horizontal plane, fuel supporting members extending downwardly from said manifold to support the fuel below said manifold.

2. A stove as recited in claim 1 wherein said fuel supporting members comprise a plurality of generally U-shaped pipes, both ends of each pipe being in fluid communication with said manifold.

3. A stove as recited in claim 2 wherein said short-circuit preventing means comprises a baffle dividing the interior of said manifold with said inlet pipe on one side of said baffle, and said outlet pipe on the other side of said baffle, and wherein one end of each of said pipes is in communication with said manifold on one side of said baffle, and the other end of each pipe is in communication with said manifold on the other side of said baffle.

4. A stove as recited in claim 2 further comprising movable gas-flow control means associated with said manifold and positioned with respect to said flue so that in one position of said gas-flow control means off-gases from a fire burning in the fire chamber pass past the bottom of said manifold and out said flue, and in another position of said gas-flow control means off-gases necessarily pass past the bottom and the top of said manifold and then out said flue.

5. A stove as recited in claim 4 wherein said gas-flow control means comprises a damper located approximately the same horizontal level as said manifold and adjacent the wall in which said flue is disposed and below said flue, and further comprising a damper control means located on the exterior of said stove for moving said damper between two gas controlling positions.

6. A stove as recited in claim 2 wherein said means for supporting said manifold in a generally horizontal plane includes means for releasably attaching said inlet and outlet pipes to one of said walls.

7. A stove as recited in claim 2 wherein said supporting means comprises a pair of ledge supports extending horizontally along the interior of two of said walls for engaging bottom edges of said manifold.

8. A stove as recited in claim 2 further comprising an air vent in said manifold.

9. A stove as recited in claim 1 wherein said walls defining the fire chamber include a pair of top wall portions disposed above said manifold and disposed at different vertical levels from each other.

10. A stove as recited in claim 9 further comprising movable gas-flow control means associated with said manifold and positioned with respect to said flue so that in one position thereof off-gases from a fire burning in said fire chamber pass past the bottom of said manifold and out said flue, and in another position thereof, the off-gases necessarily pass past the bottom of said manifold and past the top of said manifold between the top of said manifold and said stove top wall portions before going out said flue.

11. A stove as recited in claim 1 wherein said means for supporting said manifold in a generally horizontal plane includes means for releasably attaching said inlet and outlet pipes to one of said walls.

12. A stove as recited in claim 1 wherein said supporting means comprise a pair of ledge supports extending horizontally along the interior of two of said walls for engaging bottom edges of said manifold.

13. A stove as recited in claim 1 further comprising movable gas-flow control means associated with said manifold and positioned with respect to said flue so that in one position of said gas-flow control means off-gases from a fire burning in the fire chamber pass past the bottom of said manifold and out said flue, and in another position of said gas-flow control means off-gases necessarily pass past the bottom and the top of said manifold and then out said flue.

14. A stove as recited in claim 13 wherein said gas-flow control means comprises a damper located approximately the same horizontal level as said manifold and adjacent the wall in which said flue is disposed and below said flue, and further comprising a damper control means located on the exterior of said stove for moving said damper between two gas controlling positions.

15. A stove as recited in claim 1 wherein said door includes a member pivotally mounted to a wall of said stove, and wherein adjustable vent means are provided in said door for controlling the amount of combustion air that can flow into the fire chamber.

16. A stove as recited in claim 3 wherein said baffle comprises an angle iron having one leg thereof extending vertically between the top and bottom of said manifold, and the other leg thereof operatively connected to the top or the bottom of said manifold.

17. A stove as recited in claim 16 wherein the other leg of said angle iron is connected to the top or the bottom of said manifold by a plug affixed to said angle iron and extending through the manifold and welded around the periphery thereof to the top or bottom of the manifold.

* * * * *